United States Patent [19]

Ott

[11] 4,047,606

[45] Sept. 13, 1977

[54] HEAD FOR NEEDLE PRINTER

[75] Inventor: Hubert Ott, Ulm, Germany

[73] Assignee: Mannesmann Aktiengesellschaft, Dusseldorf, Germany

[21] Appl. No.: 678,357

[22] Filed: Apr. 19, 1976

[51] Int. Cl.[2] ..... B41J 3/04

[52] U.S. Cl. ..... 197/1 R; 308/3 R

[58] Field of Search ..... 197/1 R; 101/93.04, 101/93.05; 308/1 R, 3 R, 3 A, 6 R, 6 B

[56] References Cited

U.S. PATENT DOCUMENTS

| | | | |
|---|---|---|---|
| 3,467,232 | 9/1969 | Paige | 197/1 R |
| 3,672,482 | 6/1972 | Brumbaugh et al. | 197/1 R |
| 3,795,298 | 3/1974 | Kodis | 197/1 R |
| 3,802,543 | 4/1974 | Howard | 197/1 R |
| 3,991,871 | 11/1976 | McIntosh, Sr. | 197/1 R |

FOREIGN PATENT DOCUMENTS

| | | | |
|---|---|---|---|
| 949,386 | 6/1974 | Canada | 197/1 R |
| 2,153,005 | 5/1973 | Germany | 197/1 R |
| 2,420,005 | 11/1974 | Germany | 197/1 R |

*Primary Examiner*—Clifford D. Crowder
*Attorney, Agent, or Firm*—Ralf H. Siegemund

[57] ABSTRACT

The needles in a printing head are guided in curved contour through plural, spaced apart guide plates having double cone bores arranged and configured to follow and determine the needle curving contour. The needles are contained in the usual conical housing whose wide rear end carries the needle drivers.

3 Claims, 5 Drawing Figures

HEAD FOR NEEDLE PRINTER

BACKGROUND OF THE INVENTION

The present invention relates to a needle printer of the type in which a plurality of printing needles are disposed in a conical housing. More accurately, such housing should be termed truncated because the tips of the needles project through the apex region in the front of the cone and in spaced-apart relation from each other.

The conical housing containing the printing needles establishes the printing head of the printer. Such printing heads are known and they include the base plate in the larger diameter rear portion of the cone which base plate carries the drivers for the needles. The needles must be held to some extent in the conical head and German printed patent application No. 1,249,570 discloses guide ducts for them. Lateral forces cause the needles to engage the duct walls in particular areas which establish a particular inflexibility in the guiding. In order to avoid unduly high friction, a relative large, overall play is needed but without compromising the accuracy of the guiding. Therefore, this particular guiding structure is rather complicated and expensive. Of course, one could use additional lateral forces in order to avoid an indefinite position of the printing needles but that would constitute an additional expenditure.

The German printed patent application No. 2,119,417 discloses a different kind of needle guiding system. In this case, each needle is held in a helical, metal wire coil. Unfortunately, it was found that in this particular kind of arrangement any shock and impact movement, i.e., rapid acceleration and deceleration of the needle produces lateral oscillations of the coils which are transmitted upon the needles and the tips will experience this lateral motion, at least to some extent, so that the particular printing pattern becomes distorted and blurred.

DESCRIPTION OF THE INVENTION

It is an object of the present invention to provide a new and improved printing head for a needle printer in which the needles are accurately guided in predetermined guiding paths. In addition, such a printer and here particularly the guiding structure for the needles, should be easy to manufacture and easily assembled.

In accordance with the preferred embodiment of the present invention, it is suggested to provide a plurality of axially spaced-apart guiding plates inside of the conical needle housing, which guiding plates each have a plurality of double-cone guide bores, and the particular bores in the several plates are mutually oriented and positioned to guide the needles in and along particular paths, the needles being curved spacially accordingly. The particular guiding plates should have a spacing from each other which is about 10 to 20 fold the value of the diameter of the printing needles. In addition, each of the guiding plates should have a thickness of about 8 to 12 the value of the needle diameter. The conicity of the double-cone bore as associated with one particular needle differs from guide plate to guide plate in order to match the cone angle to the relative angle the needle has in relation to the axis of the cone of the housing. The conicity of each of the double cones of one particular bore is preferably the same.

However, those guide plates which are located close to the tip end of the head may have wider entrance cones than needed on account of the curvature of the needles, simply to facilitate threading the needle through. However, for most of the guide bores, the conicities of the respective two cones of a double cone should be the same.

It was found that a guide system for the printing needles of a needle printer constructed in accordance with the invention avoids transverse oscillations. The needles can be easily threaded into and through the bores, and one does not need additional equipment for this assembly step. The resulting curvature of the threaded-through needle is defined by position, orientation and conicity of the guide bores in the several plates and is obtained and maintained automatically just upon inserting a needle.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIGS. 3 and 4 show the printing head basically in its entirety. The head is comprised of a conical housing 1 whose apex region constitutes the front end of the head. In view of the configuration of this front end, the housing actually has truncated conical configuration. The front end or mouth of the head is established by an annulus 13. The housing has a rear end base plate 12, and a plurality of electromagnetic drivers 2 are mounted on that plate 12 extending outwardly from the interior of the cone. Each of these drivers drives one printing needle, there being a plurality of needles accordingly. For the sake of clarity, only one of these needles is shown in FIG. 3, (needle 3) but a plurality of each portion of these needles is shown near the mouthpiece region 13 of the head. The needle tips are vertically aligned or slightly staggered.

Figure 3:
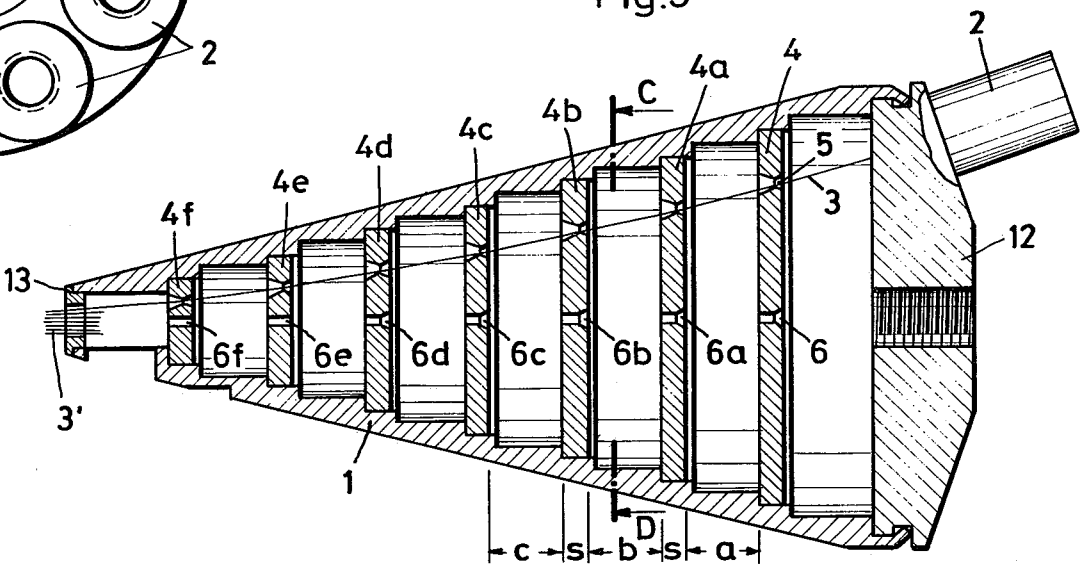
FIG. 3 is a cross-section through an entire needle printer head improved in accordance with the preferred embodiment of the present invention.
Figure 4:
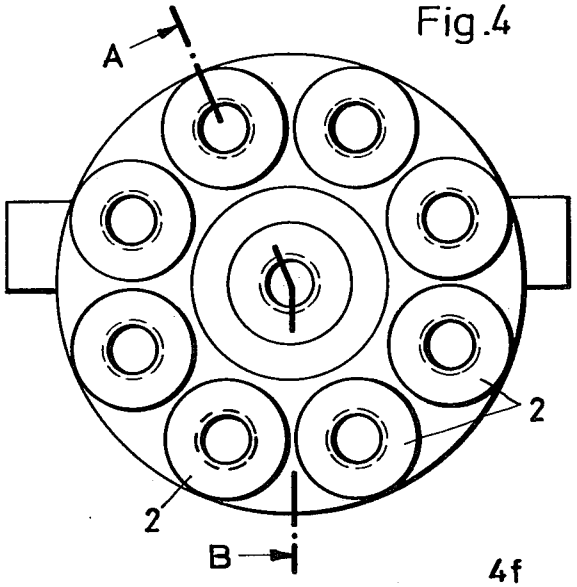
FIG. 4 is a rear view of the head shown in FIG. 3.

The interior space of the conical housing is partitioned by means of guide plates for the needles. These guide plates are denoted respectively with reference numerals or characters 4, 4*a,* 4*b,* etc., through 4*f.* These plates extend parallel to each other and to the base plate 12. Moreover, all these plates extend transversely to the center axis of the conical housing. Each of these plates 4, etc., has a plurality of double-cone bores. Only one of these bores per plate is shown in FIG. 3, and they are correspondingly identified by the reference character 5, 5*a,* etc., through 5*f.* See also FIG. 5.

The plates 4, 4*a,* etc., are spaced apart axially by distances *a, b, c,* etc., which are about 10 to 20 fold the diameter of a printing needle such as 3. The plates 4, 4*a,* etc., themselves have a thickness which is about 8 to 12 times the diameter of the printing needles. The needles extend from their respective drive through one aperture per guide plate whereby the relative orientation and disposition of these apertures in relation to each other determine and follow the curved contour of each needle. All needles extend through the front end mouthpiece and their tips are vertically aligned or possibly slightly staggered as was mentioned above. All but one of the needles have a curved contour following a space curve, but the center needle 3′ runs straight on the cone's axis. The particular apertures for that center needle have slightly different configurations as will be explained shortly.

Figure 1:
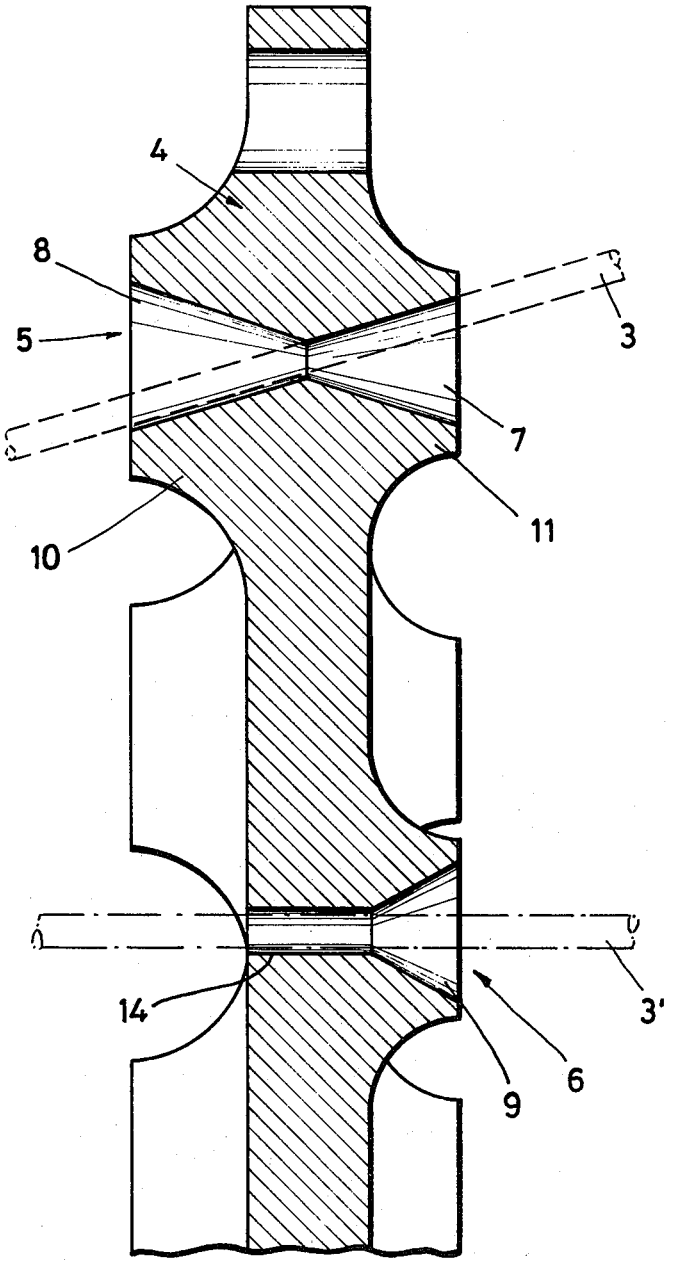
FIG. 1 is an axial section view through a portion of one of the guide plates for a needle printer head constructed in accordance with the preferred embodiment of the present invention.
Figure 2:
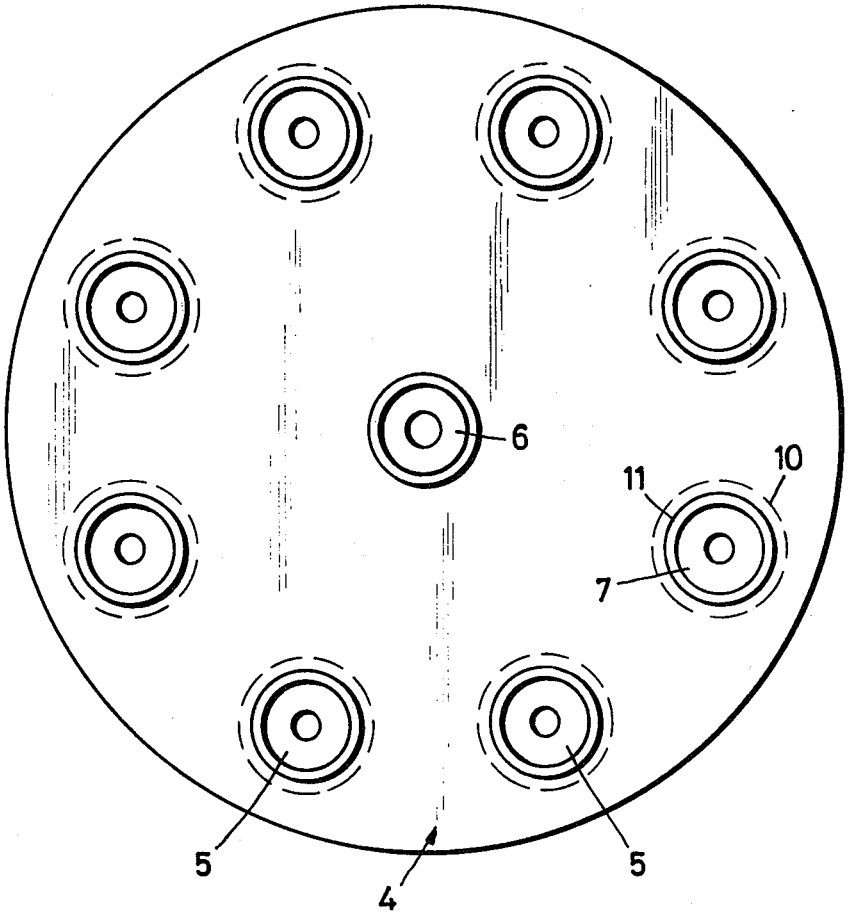
FIG. 2 is a front view of one of these front plates.
Figure 5:
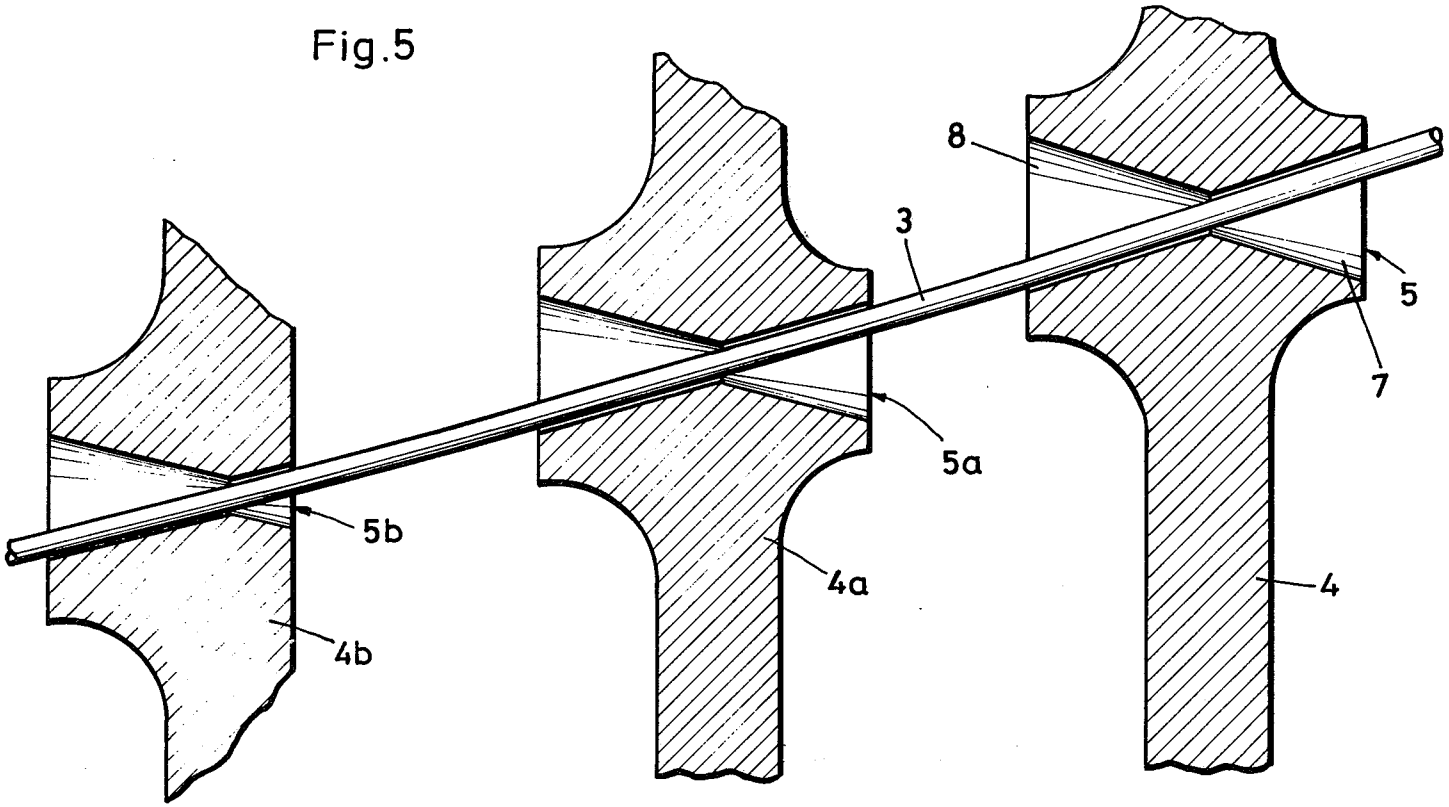
FIG. 5 is an enlarged cross-section view through portions of several guide plates illustrating the guide passage for one particular printing needle.

Details of the guide bores in the several guide plates are derivable from FIGS. 1 and 5. It should be mentioned that the plates as shown in FIG. 3 are presumed to be made of light plastic material. If heavier material, e.g., metal is used, they may be slightly differently configured. Particularly each such plate may be rather thin in order to reduce the weight but the plates carry thicker bosses 10 and 11 on both sides which are axially aligned in pairs, and two such protrusions or bosses together define the region for the double-cone bore 5. The dimension given above for plate thickness in relation to needle diameter actually refers to the guide portions as established by the bosses or protrusions.

Each guide bore such as 5 is composed of two cones 7 and 8 with joined overlapping apices for defining a narrower passage having a diameter just a little larger than the diameter of the needle passing through. Cone 7 is provided as threading, or entrance cone which in addition to a guiding function for the needle facilitates threading of that needle through the aperture. The needles are inserted upon assembly beginning at the widened end of housing 1, plate 12 possibly being removed at that point. The companion cone 8 of a double cone constitutes the exit cone for a needle. That exit cone has only a guiding function. Generally cone 8 is about 20% higher, that is, deeper than cone 7. However, as shown in FIG. 5 there are deviations from that rule.

The cones are contoured so that the needle readily fits snuggly along the aligned slanted contour portions of the two cones. The needle will fit through with some play. The needle has curved configuration, but that curvature is minute as far as each individual aperture or bore is concerned. The curvature of a needle is developed basically along its main path and is noticeable only over the entire, relatively large extension of each needle.

FIG. 5 is quite illustrative on this point because the needle shows only a very slightly curving contour through these guide plates. However, upon comparing bore 5*a* in plate 4*a* being closer to the tip of needle 3, with bore 5 in plate 4 being closer to the base plate 12 (FIG. 3), one can see that the exit cone 8 has a shallower apex angle than the exit cone of bore 5*a.* It can also be seen that the needles may not have to be precurved, but may assume their curvature just by being threaded through. Of course a slight prebending may reduce frictional contact.

The center needle 3′ is guided by cylindrical guide bores such as 14 each having a conical entrance bore portion 9 in each instance for facilitating the threading of the needle. In this particular case, of course, the needle is straight and this particular set of guide bores is provided for purposes of keeping that central needle on a straight path.

Strictly speaking one could term these two bore portions a double cone bore with one cone having zero apex angle. It will be appreciated that the apex angles define locally the relative angle of a printing needle to the center axis (or an axis running parallel thereto). A center needle has zero angle in this regard, so that the "cones" of the guide bore portions also have zero apex angles accordingly.

The invention is not limited to the embodiments described above but all changes and modifications thereof not constituting departures from the spirit and scope of the invention are intended to be included.

I claim:

1. A printing head for needle printers having a plurality of printing needles respectively driven by drivers, the head having a conical housing whose base plate carries said drivers, the needles extending to and through the apex region of the housing, the tips of the needles extending from the housing at said region being the front end of the head, the improvement comprising:

a plurality of guide plates in the housing disposed therein in spaced-apart relation to each other and spaced along the axis of the conical housing; and a plurality of bores in each of the plates for being passed through by the needles, the needles each having a curved contour and a particular diameter, the bores being composed of two cones with joined overlapping apices forming an entrance cone portion and an exit cone portion having larger height than the entrance cone portion, the narrowest portion of the bore being located where the entrance cone portion meets the exit cone portion having diameter only slightly larger than the needle passing through, each plate having a thickness at least in the region of the respective bores having value which is about eight to twelve times the diameter of the respective needle passing through, the bores in the guide plates being arranged, oriented and positioned in relation to each other, and configured as to follow the contour of the needles in that the exit cone portion of a bore in a plate of the plurality being closer to a tip of the needle passing through having a steeper cone angle than the exit cone portion of a bore in a plate of the plurality closer to the base plate and being passed through by the same needle.

2. A printing head as in claim 1, each needle having a particular diameter, the plates being spaced by a distance being about 10 to 20 times the value of the diameter of the needles.

3. A printing head as in claim 1, said plates having locally thicker portions containing said bores, the plates being thinner accordingly in regions between and around said bores.

* * * * *